US005503101A

United States Patent [19]

Mullinix

[11] Patent Number: 5,503,101

[45] Date of Patent: Apr. 2, 1996

[54] AUDIBLE PUSH-UP DETECTOR

[76] Inventor: Maurice J. Mullinix, 4876 Brentridge Ct., Greenwood, Ind. 46143

[21] Appl. No.: 347,073

[22] Filed: Nov. 23, 1994

[51] Int. Cl.[6] ..... G08B 3/06; G10K 9/04

[52] U.S. Cl. ..... 116/67 R; 116/139; 116/203

[58] Field of Search ..... 5/449, 904; 273/457, 273/458; 472/53, 56; 482/84, 140, 141; 446/184, 186, 197, 26; 116/24, 67 R, 137 R, 139, 203

[56] References Cited

U.S. PATENT DOCUMENTS

| | | | |
|---|---|---|---|
| 2,712,201 | 7/1955 | Wintriss | 116/139 |
| 2,721,420 | 10/1955 | Chatten | 446/26 X |
| 2,822,554 | 2/1958 | Wenzelberger | 5/449 X |
| 3,421,163 | 1/1969 | Stoughton | 5/449 |
| 4,700,369 | 10/1987 | Siegal et al. | 377/24 |
| 4,899,406 | 2/1990 | Sanderson et al. | 5/449 |
| 5,242,355 | 9/1993 | Costa | 482/141 |
| 5,276,426 | 1/1994 | LoBello | 340/436 |

FOREIGN PATENT DOCUMENTS

| | | |
|---|---|---|
| 607156 | 11/1978 | Switzerland . |
| 84-02660 | 7/1984 | WIPO . |

*Primary Examiner*—William A. Cuchlinski, Jr.
*Assistant Examiner*—Willie Morris Worth
*Attorney, Agent, or Firm*—Richard C. Litman

[57] ABSTRACT

An audible push-up detector produces a sound when the device is compressed between the chest of a user and the underlying floor or surface, thus alerting an instructor or supervisor, as well as the user of the device, that the exercise has been performed properly. The device comprises a hollow, air filled flexible, pliable, resilient container having a reed valve or the like installed in one side. When the device is compressed, as between the chest and the underlying surface when a person is performing push-ups, air within the device pneumatically actuates the reed valve to produce a sound. Thus, the device is most useful in group exercise or physical training sessions, where a single supervisor or at most a relatively few supervisory personnel must monitor a large number of persons performing push-up exercises. The device includes a spacer disposed therebeneath, to position the pneumatic device at the proper height. The spacer is preferably a solid block, but is preferably formed of a relatively soft, resilient material to preclude injury to a person resting his/her upper body weight on the device. The spacer may be in any one of a number of various geometric shapes or forms, as desired.

14 Claims, 3 Drawing Sheets

AUDIBLE PUSH-UP DETECTOR

FIELD OF THE INVENTION

The present invention relates generally to exercise aids and equipment, and more specifically to a pneumatic device which produces a sound when compressed under the chest of a person performing a proper, deep push-up exercise. When the device is compressed between the exercising person's chest and the underlying surface, air within the hollow interior of the device is forced outward through a reed valve or the like, producing a sound.

BACKGROUND OF THE INVENTION

The value of exercise and physical conditioning has long been recognized, and has become increasingly important in contemporary, increasingly sedentary society. Accordingly, schools, various associations and clubs, the military services, etc. require or provide various levels of physical training, conditioning, calisthenics and/or exercise for their members.

A classic calisthenic exercise for strengthening and conditioning the upper chest and shoulders is the push-up, wherein a prone person maintains a straight and rigid back posture and line from shoulders to toes and pushes the body upward using his/her arms. The use of this exercise in varying numbers of repetitions is well known, particularly in group situations where such calisthenic exercises are performed in formation or in unison.

Generally, a single leader or instructor issues instructions to an entire group in such situations, and monitors the individuals in the group to ensure that the specific exercise called for is performed properly by each individual. This can be difficult in relatively large groups of perhaps a dozen or more individuals, perhaps ranging upward to well over a hundred individuals in military physical training involving an entire company. Even with cadre or staff providing assistance, it is likely that some individuals will perform a given calisthenic exercise incorrectly and will nevertheless remain undetected.

This is particularly true of push-ups, wherein the upper body must be lowered very close to the ground or underlying surface and then pushed away, in order for the maximum effect to be gained from the exercise. It will be apparent that it can be very difficult, to say the least, to observe a large number of persons performing such an exercise and to determine with any degree of accuracy whether or not every person is performing the exercise properly.

Accordingly, the need arises for an audible push-up detector which may be placed beneath the chest of a person performing such an exercise, which detector will emit a sound when it is compressed between the chest and the underlying surface as occurs when the push-up is performed properly. The device must be relatively inexpensive to manufacture and thus to purchase, in order to provide for universal use in a large group. The device must be constructed of relatively soft and pliable materials, in order to preclude injury to a user thereof who rests his/her entire upper body weight on the device, and some height adjustment means must be provided for different individuals and the degree of difficulty desired for performing the exercise.

DESCRIPTION OF THE PRIOR ART

U.S. Pat. No. 4,700,369 issued to Joseph J. Siegal et al. on Oct. 13, 1987 discloses an Athletic Activities Counter primarily intended for lap counting in swimming and running. The device includes electronic means for keeping count, unlike the present invention which has no complex and costly electronics. No disclosure is made of any capability of producing any audible sound or noise, nor of any remote display of the readout from the device. Thus, while the device may be used to count the number of push-ups performed by a person using the device, the record is visible only to the user and no indication is provided to an instructor or other person some distance away, as provided by the present invention.

U.S. Pat. No. 5,242,355 issued to Kathleen Costa on Sep. 7, 1993 discloses an Exercise Apparatus comprising an electronic counter actuated by a mechanical plunger arm intermittently closing an electrical switch, unlike the purely pneumatic and non-electrical operation of the present invention. As in the case of the Siegal lap counter discussed above, the readout is disposed directly beneath the user, and is thus not easily visible to others. No disclosure is made of any audible means of operation, to alert others of a properly completed exercise, as provided by the present invention.

U.S. Pat. No. 5,276,426 issued to Peter J. LoBello on Jan. 4, 1994 discloses an Overhead Obstruction Sensing Device comprising an electronic device having a contact wire extending upwardly therefrom. Movement of the wire activates a light and/or buzzer in the cab of the truck. The relatively complex and costly electronic circuitry and configuration are not suitable for use in the environment of the present invention.

Swiss Patent Document No. 607,156 to Gody W. Styger and published on Nov. 30, 1978 discloses a mechanical device for counting laps while swimming, comprising a pneumatic pad which causes a wheel to turn incrementally within a housing when the pad is compressed. A plurality of numbers are secured about the wheel, with the wheel causing the next number in sequence to be displayed at each compression of the pad and incremental movement of the wheel. No audible annunciation means is disclosed, nor is the device suitable for placement beneath the chest of a person doing push-ups, as in the adaptation of the present invention.

Finally, PCT Patent No. 84/02660 to Diversified Products Corporation and published on Jul. 19, 1984 discloses an Adjustable Push-Up Stand comprising a bar bent to provide two parallel legs, with raised ends connecting the two legs. A user grips the raised ends to perform push-ups, rather than placing the palms of the hands on the floor, as is done conventionally. The device does not provide any means for determining whether or not a push-up has been performed properly, as provided by the present invention.

In addition to the above discussed patents, applicant is aware of pneumatic toys molded or formed to resemble animals or other caricatures. The generally rounded, irregular bioform shapes and configurations of such toys do not lend themselves to stable placement beneath the chest of a person, and tend to roll or otherwise move when compressed unless tightly held in place by some means. The present invention is adapted specifically to be placed beneath the chest of a person performing push-ups.

None of the above noted patents, taken either singly or in combination, are seen to disclose the specific arrangement of concepts disclosed by the present invention.

SUMMARY OF THE INVENTION

By the present invention, an improved audible push-up detector is disclosed.

Accordingly, one of the objects of the present invention is to provide an improved push-up detector which is adapted to be placed beneath the chest of a person performing push-ups, and which device provides an audible signal or sound to the surrounding area to alert an instructor or other supervisory person, when the exercising person has properly performed a push-up.

Another of the objects of the present invention is to provide an improved push-up detector which includes means providing for the proper spacing of the detector from the floor or underlying surface, as desired.

Yet another of the objects of the present invention is to provide an improved push-up detector which is activated pneumatically by compression between the chest of a user and the underlying floor or other surface, to provide an audible tone or sound by means of a reed valve or the like.

Still another of the objects of the present invention is to provide an improved push-up detector which spacing means may take any one of a number of various geometric forms, as desired.

A further object of the present invention is to provide an improved push-up detector which detector portion is preferably formed of a relatively soft, pliable and resilient hollow, air filled rubber or vinyl plastic material or the like, and which underlying spacing means is formed of a relatively soft, pliable and resilient material, in order to preclude injury to a person using the device in the event the person rests his or her chest and upper body upon the device.

An additional object of the present invention is to provide an improved push-up detector which is devoid of electronic components and/or circuitry, thus providing simplicity of operation and durability for the device.

A final object of the present invention is to provide an improved audible push-up detector for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the figures of the attached drawings.

DETAILED DESCRIPTION OF THE PREFERRED EMBODIMENTS

Figure 1:
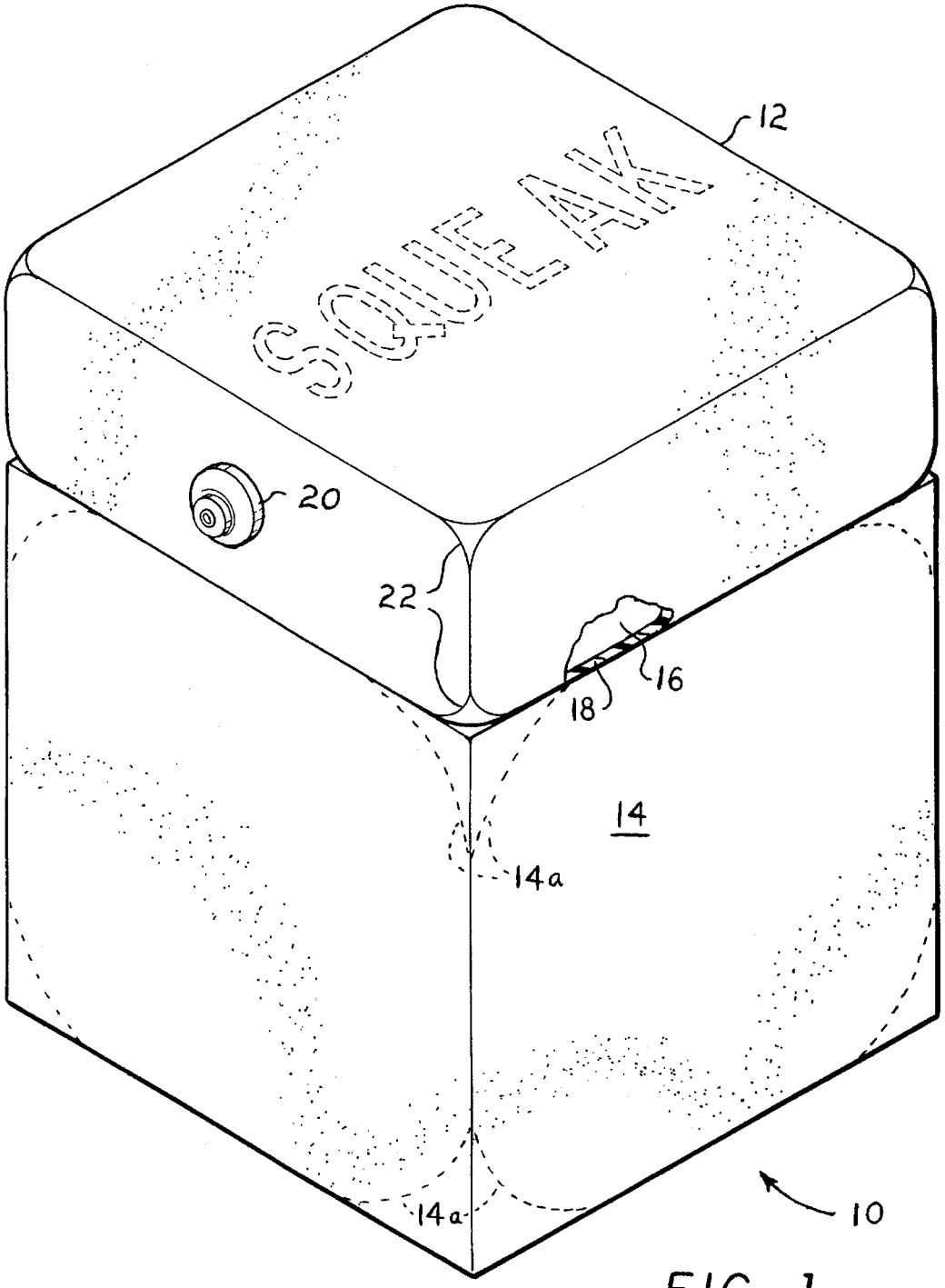
FIG. 1 is a perspective view of the push-up detector of the present invention, showing the hollow upper pneumatic component including the sound emitting means, and one embodiment of a lower spacing or height adjustment means.

Referring now particularly to FIG. 1 of the drawings, the present invention will be seen to relate to an audible push-up detector 10, serving to provide audible notice to a person properly performing push-up calisthenics or exercises, or to a supervisor, instructor, or other person in the area, that a push-up has been performed properly, i.e., with sufficient depth to provide appropriate exercise of the proper muscle groups. The push-up detector 10 basically comprises two components: A detector portion 12, and a block 14 serving to position the detector portion at the proper height above the surface being used for the exercises.

The detector portion 12 is formed of an air filled hollow, resilient, pliable, and compressible material, with the air filled interior 16 defined by a continuous wall 18 therearound. One side includes a pneumatic sound producing device 20 extending through the wall 16, with the sound producing means 20 being activated by air passage therethrough, from the interior 16 to the outside environment. The sound producing means 20 may comprise a reed valve, or other means producing a sound when air is passed thereover or therethrough.

It will be noted that the detector portion 12 is particularly adapted to placement beneath the chest of a person performing push-ups, as it has rounded corners and edges 22, devoid of sharp protrusions, thereby precluding injury to a person using the detector portion 12. As the detector 10 is intended to be placed beneath the chest area, with its hard sternum or breastbone therein, it is important that no sharp edges, corners or protrusions exist in order to preclude injury should an exercising person rest his or her upper body upon the detector 10.

Figure 3:
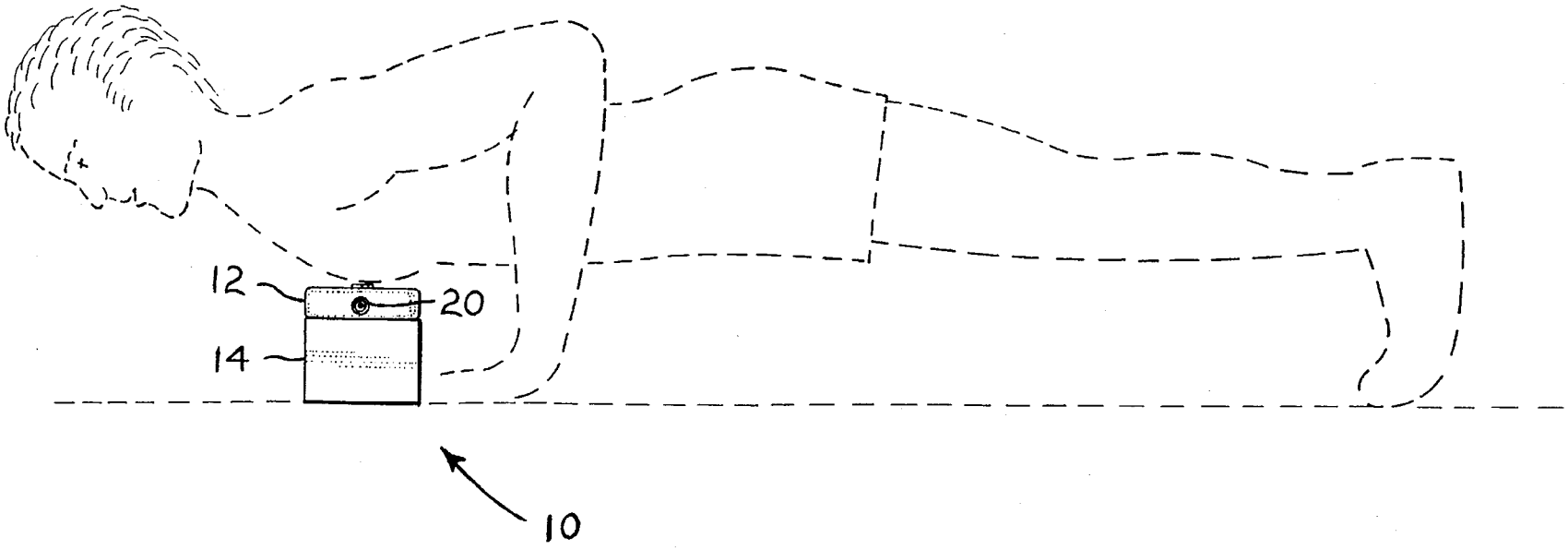
FIG. 3 is an environmental left side elevational view in reduced scale, showing the audible push-up detector of the present invention in use.

The shape of the detector portion 12 is also particularly adapted to positioning under the chest of a person performing push-ups, with the device 12 being relatively wide and flat and having a thickness considerably less than its horizontal dimensions. Thus, the detector portion 12 is stable when resting upon its relatively wide bottom surface, as shown in FIG. 3, and resists rolling or other motions which would displace other less stable devices (e.g., rounded or irregularly shaped pneumatic toys, etc.).

The detector portion 12 is relatively thin in the vertical dimension being only on the order of 1.5 inches thick. (Other dimensions may be used as desired). Thus, if the detector portion 12 is placed directly upon a floor or other underlying surface being used for exercise, a person performing push-ups thereon would have to lower his/her chest to less than 1.5 inches from the surface in order to compress the detector portion 12 and cause it to produce a sound. Such a relatively low height is much lower than that needed to exercise the shoulder, arm and chest muscle groups properly when performing push-ups, and accordingly, a height block 14 may be used to position the detector portion 12 at the proper height above the underlying surface. The height positioning block 14 is preferably on the order of four inches high, resulting in compression of the detector portion 12 when the chest of an exercising person thereover reaches a point on the order of 5.5 inches above the underlying surface. This is considered to be an optimum lower height for persons performing push-ups, providing optimum exercise for the shoulder, chest and upper arm muscle groups primarily involved in such exercise. However, it will be noted that the height of the block 14 may be modified for different sizes and ages of exercisers, etc., as desired.

Figure 2B:
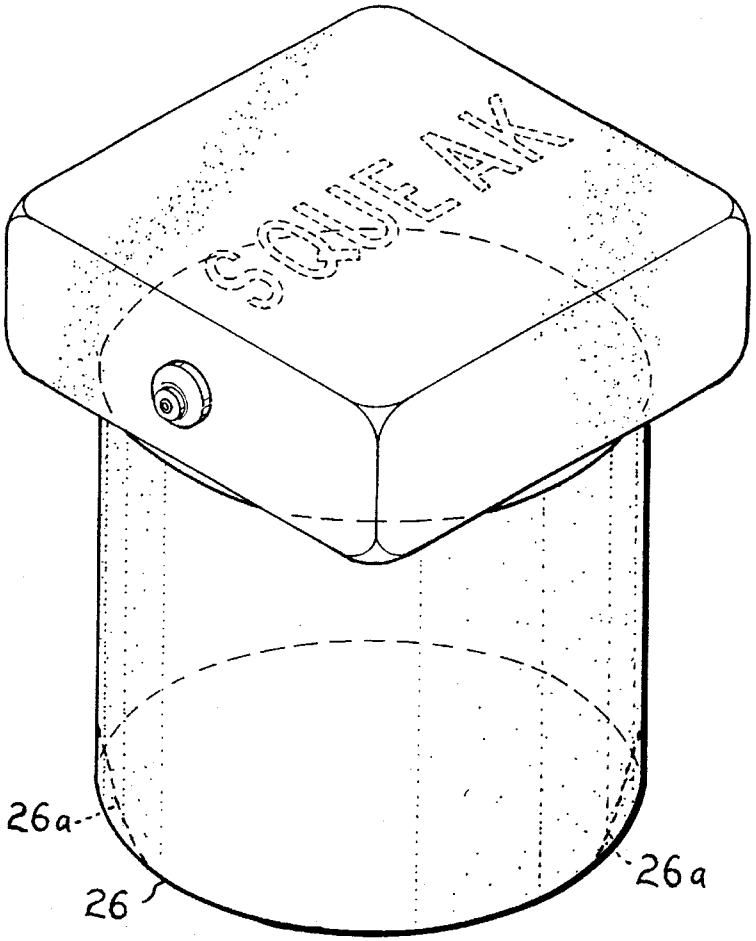
FIG. 2B is a perspective view of a third embodiment of the present invention, having a cylindrically shaped spacer.
Figure 2A:
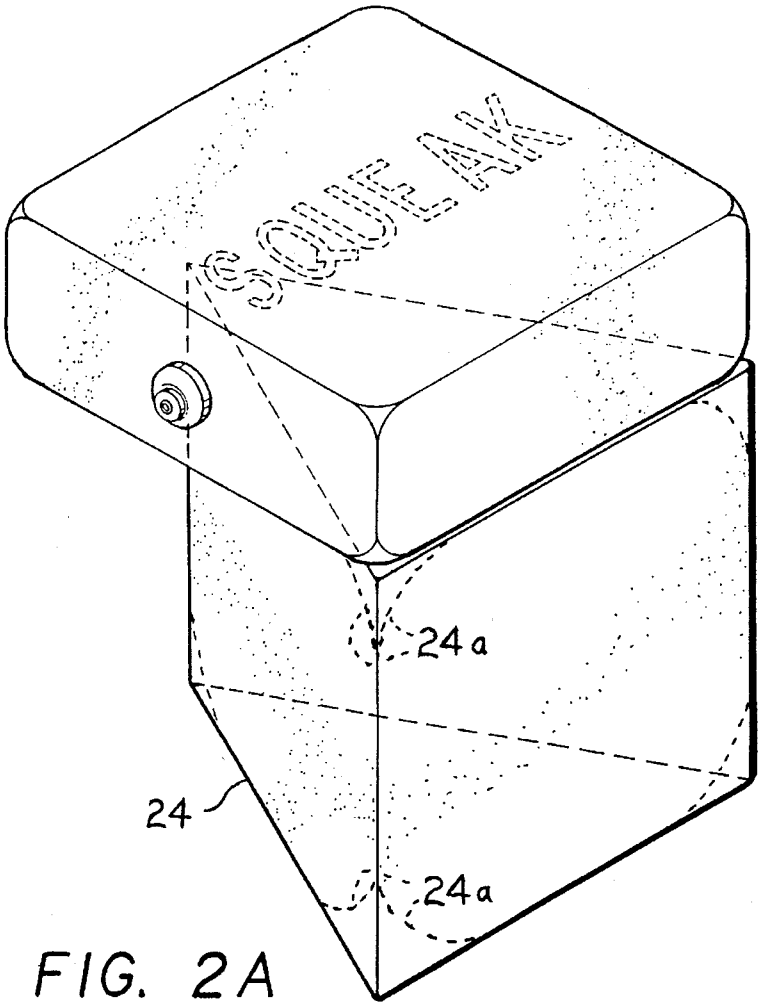
FIG. 2A is a perspective view of a second embodiment of the present invention, having a triangularly shaped spacer beneath the pneumatic component.

Preferably, the block 14 is formed as a solid, uniform, monolithic piece or component, having a regular geometric shape, such as the right rectangular prism or cube 14 shown in FIG. 1. Other shapes may be used as desired, such as the triangular prism 24 of FIG. 2A and the cylindrical block 26 of FIG. 2B. It is not intended to limit the shapes to only those shown in the accompanying drawing figures and discussed herein, but rather to show exemplary shapes which may be used in combination with the detector portion 12 of the present invention.

The height positioning block 14/24/26 is preferably formed of a relatively compliant and resilient material, for the same reasons noted above for the detector portion 12, i.e., to preclude injury to the sternum or other area of an exercising person who might fall or contact the block 14/24/26 with their upper body during exercise. Materials such as a closed cell foam plastic, which provide reasonably firm support without collapse, and yet provide adequate support to cause the compression of the detector portion 12 between the chest of an exercising person and the block 14/24/26, are suitable; other materials may be used as desired. It is also possible to round the various corners of the blocks 14/24/26 as desired for further safety. Broken lines are used to show the alternative rounded corners and edges 14*a* of the block 14 of FIG. 1, 24*a* of the block 24 of FIG. 2A, and 26*a* of the block 26 of FIG. 2B.

The above described audible push-up detector 10 will be seen to provide a very economical means for an instructor or group leader to determine whether or not persons performing push-up calisthenics are preforming the exercise properly and thereby achieving maximum benefit. As the detector 10 produces an audible sound when compressed beneath the chest of an exercising person, the individual performing the push-up exercises will also be aware of whether or not the exercise is properly performed, as shown in FIG. 3 of the drawings. The purely pneumatic sound means used in the present detector 10 precludes relatively costly and complex electronics, and thus does not require extension cords or periodic replacement of batteries, etc. The shape of the detector portion 12 and underlying support or height positioning means 14 are adapted particularly to provide stability for the detector 10, and preclude rolling or shifting of the detector portion 12 during exercise and contact. The materials used are preferably soft and resilient, to preclude injury to a person due to hard bodily contact with the person, and all corners and edges of both the detector portion 12 and the height positioning block 14 may be rounded as desired to provide further safety.

It is to be understood that the present invention is not limited to the sole embodiment described above, but encompasses any and all embodiments within the scope of the following claims.

I claim:

1. An audible push-up detector, comprising:

a detector portion having a hollow, air filled center and a resilient, pliable surrounding wall, with a pneumatically actuated sound producing means installed through said wall and providing for air passage therethrough;

said detector portion comprising a substantially low, flat shape adapted for stable placement on a surface underlying a person performing push-up exercises and beneath the person's chest, and;

height positioning means adapted to position said detector portion at a height above the underlying surface to provide for actuation of said sound producing means by compressive contact with the person's chest when a push-up is properly performed by the person thereover performing push-up exercises, whereby;

said pneumatically actuated sound producing means produces a sound when said detector portion is compressed by the person thereover properly performing a push-up exercise, thus causing air to be expelled through said pneumatically actuated sound producing device and thereby providing notice to the person thereover and to others in the area that the push-up exercise has been properly performed.

2. The audible push-up detector of claim 1, wherein:

said pneumatically actuated sound producing means comprises a reed valve within an orifice disposed through said wall of said detector portion.

3. The audible push-up detector of claim 1, wherein:

said detector portion is formed of a flexible plastic material.

4. The audible push-up detector of claim 3, wherein:

said flexible plastic material is chosen from the group consisting of vinyl and polyurethane plastics.

5. The audible push-up detector of claim 1, wherein:

said detector portion is formed of an elastomer material.

6. The audible push-up detector of claim 5, wherein:

said elastomer material is chosen from the group consisting of natural and synthetic rubber.

7. The audible push-up detector of claim 1, wherein:

said detector portion includes smoothly rounded edges and corners, devoid of sharp protrusions, thereby precluding injury to a person supporting the person's upper body weight thereon while performing push-up exercises.

8. The audible push-up detector of claim 1 wherein:

said height positioning means comprises a solid block of material having a regular geometric shape.

9. The audible push-up detector of claim 8 wherein:

said height positioning means includes smoothly rounded corners and edges, devoid of sharp protrusions.

10. The audible push-up detector of claim 8 wherein:

said height positioning means is formed of a resilient, compliant material, thereby precluding injury to a person supporting the person's upper body weight thereon while performing push-up exercises.

11. The audible push-up detector of claim 10 wherein:

said height positioning means is formed of a closed cell foam material.

12. The audible push-up detector of claim 9 wherein:

said height positioning means is in the form of a cube.

13. The audible push-up detector of claim 9 wherein:

said height positioning means is in the form of a right triangular prism.

14. The audible push-up detector of claim 9 wherein:

said height positioning means is in the form of a cylinder.

* * * * *